US009999281B2

(12) United States Patent
Dholakiya

(10) Patent No.: US 9,999,281 B2
(45) Date of Patent: Jun. 19, 2018

(54) CUSTOMIZABLE PENDANT

(71) Applicant: Hasmukh Dholakiya, North Bergen, NJ (US)

(72) Inventor: Hasmukh Dholakiya, North Bergen, NJ (US)

( * ) Notice: Subject to any disclaimer, the term of this patent is extended or adjusted under 35 U.S.C. 154(b) by 288 days.

(21) Appl. No.: 15/005,333

(22) Filed: Jan. 25, 2016

(65) Prior Publication Data

US 2017/0208909 A1 Jul. 27, 2017

(51) Int. Cl.
*A44C 17/02* (2006.01)
*A44C 25/00* (2006.01)

(52) U.S. Cl.
CPC ..... *A44C 25/001* (2013.01); *A44C 17/0241* (2013.01)

(58) Field of Classification Search
CPC . A44C 17/02; A44C 17/0208; A44C 17/0241; A44C 17/025; A44C 17/00; A44C 25/001; A44C 25/007; A44C 7/002; A44C 5/00; A44C 11/002; G09F 2023/0016
USPC .... 63/28, 29.1, 30, 31, 40, 26, 21, 13, 14.1, 63/38, 33, 23; 40/618
See application file for complete search history.

(56) References Cited

U.S. PATENT DOCUMENTS 1,442,815 A * 1/1923 Maker ..... A44C 17/02 29/10
1,973,616 A * 9/1934 Fleeman ..... G09F 7/10 40/618
2,342,237 A * 2/1944 Barbieri ..... A44C 15/004 156/245
4,430,869 A * 2/1984 Zinni ..... A44C 25/001 40/618
4,879,882 A * 11/1989 Johnson ..... A44C 15/004 63/13
5,836,176 A * 11/1998 Lichtenstein ..... A44C 7/002 63/13
5,896,757 A * 4/1999 Kharloubian ..... A44C 17/025 63/28
2009/0038338 A1* 2/2009 Korwin ..... A44C 7/002 63/1.11
2014/0102139 A1* 4/2014 Barron ..... A44C 17/0208 63/26

* cited by examiner

*Primary Examiner* — Jack W Lavinder
(74) *Attorney, Agent, or Firm* — Jennifer Meredith, Esq.; Meredith & Keyhani, PLLC

(57) ABSTRACT

A pendant comprising: an anchor portion having three elongated sides, at least two of the three elongated sides having a plurality of supports, a first end and a second end, a bottom substantially rectangular support that is attached on three sides to the second end of each of the three elongated sides to create an open side, a bottom side and two parallel elongated sides, wherein the two parallel elongated sides have a substantially oval shape opening proximate to the first end and having the plurality of supports; wherein the bottom substantially rectangular support extends above the open side and the two parallel elongated sides; and a gemstone holder having a two side portions, a side opening between the two side portions, a top for the receipt of a gemstone and a bottom opening.

20 Claims, 12 Drawing Sheets

CUSTOMIZABLE PENDANT

BACKGROUND OF THE INVENTION

1—Priority Claim and Field of the Invention

The present invention relates generally to jewelry and a pendant that may accommodate customization and incremental purchase of gemstones.

2—Description of Related Art

Prior art pendants are generally purchased in a design and gemstone size and color that does not change or accommodate for any changes in styles or amount the purchaser wants to spend. Wearers of pendants may want to change the color of gemstones, or move them around. Users may also purchase gemstones for life events. For example, for each child, a new gemstone is purchased which represents the birth of that child. Accordingly, it would be desirable for such wearers to have a pendant that can accommodate numerous gemstones and additions and changes to the gemstones.

SUMMARY OF THE INVENTION

Aspects of the present invention provide a pendant apparatus that includes gemstones and is easily customizable.

One aspect of the present invention provides, a pendant comprising: an anchor portion having three elongated sides, at least two of the three elongated sides having a plurality of supports, a first end and a second end, a bottom substantially rectangular support that is attached on three sides to the second end of each of the three elongated sides to create an open side, a bottom side and two parallel elongated sides, wherein the two parallel elongated sides have a substantially oval shape opening proximate to the first end and having the plurality of supports; wherein the bottom substantially rectangular support extends above the open side and the two parallel elongated sides; and a gemstone holder having a two side portions, a side opening between the two side portions, a top for the receipt of a gemstone and a bottom opening.

Another aspect of the present invention provides, A pendant comprising: an anchor portion having three elongated sides, at least two of the three elongated sides having a plurality of v-shaped supports, a first end support and a second end support, at least one rounded opening attached to at least one of the first end support and the second end support, wherein the three elongated sides are attached to the first end support and the second end support to create an open side, a bottom side and two substantially parallel elongated sides; and a gemstone holder having a two side portions, a side opening between the two side portions, a top for the receipt of a gemstone and a bottom opening. While this present invention provides pendants, it should be understood it may be a bracelet or necklace pendent.

Another aspect of the present invention provides, a pendant comprising: an anchor portion having three elongated sides, at least two of the three elongated sides having a plurality of cross supports, a first end and a second end, a bottom substantially rectangular support that is attached on three sides to the second end of each of the three elongated sides to create an open side, a bottom side and two parallel elongated sides, wherein the two parallel elongated sides have a substantially oval shape opening proximate to the first end; wherein the bottom substantially rectangular support extends above the open side and the two parallel elongated sides; and a gemstone holder having a two side portions, a side opening between the two side portions, a top for the receipt of a gemstone and a bottom opening.

DETAILED DESCRIPTION OF THE INVENTION

The pendant of the present invention, improves upon the experience of wearing jewelry by allowing the wearer to have a range of gemstones that may vary in size, color and shape and a pendant that accommodates such changes while ensuring secure retaining of the gemstones.

FIGS. 1-21 depict a pendant according to the present invention.

Figure 1A:
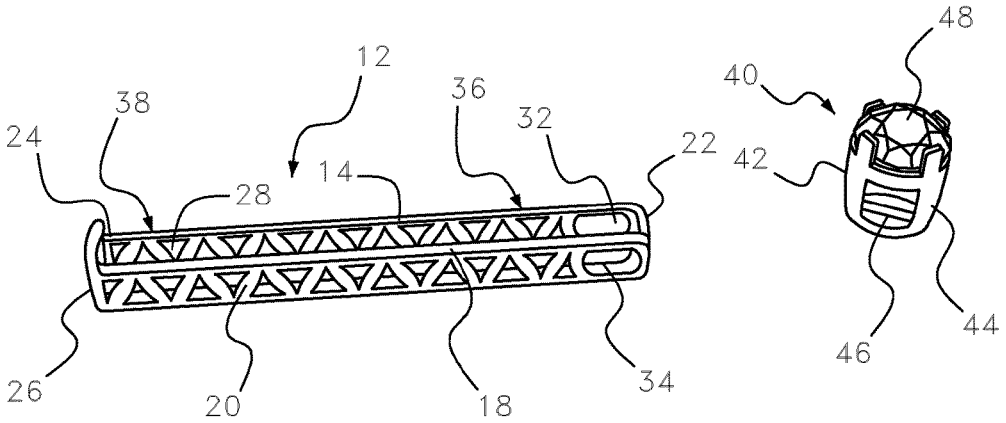
FIGS. 1A and 1B are top and bottom perspective views of the pendant as in the present invention.
Figure 1B:
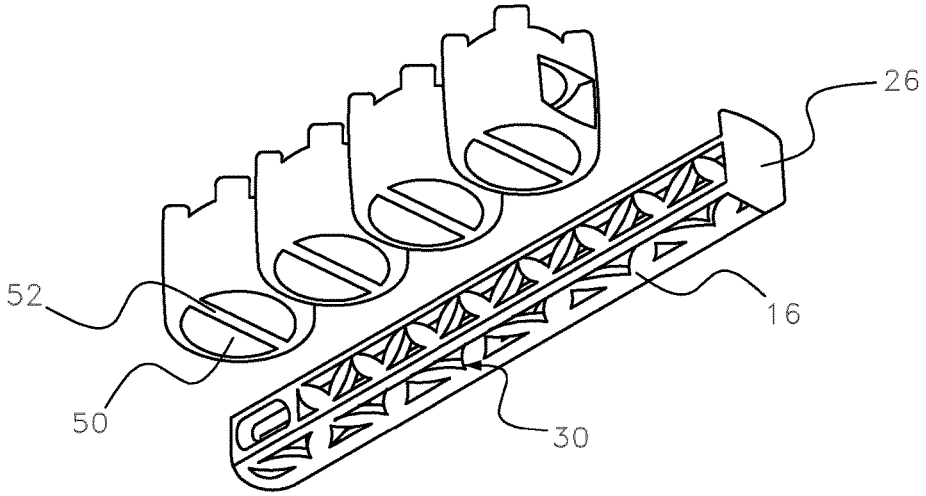
Figure 21:
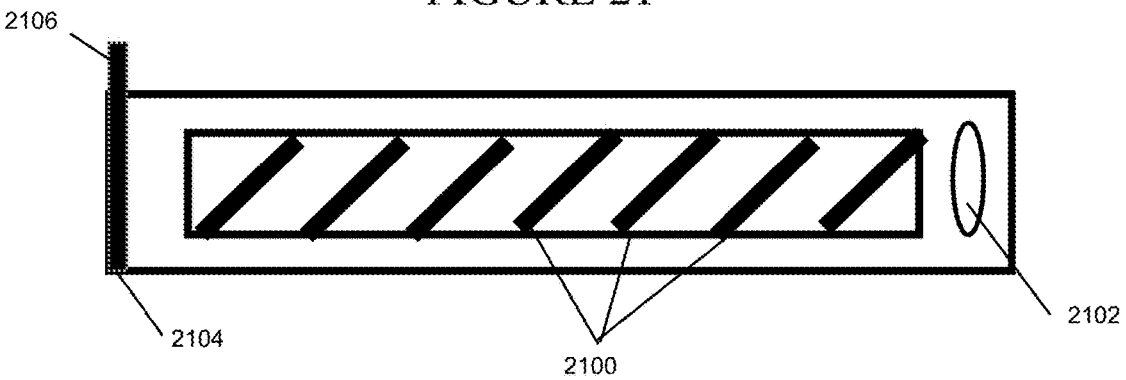
FIG. 21 depicts an alternate shape of the supports on the elongated sides.

As shown in FIGS. 1A and 1B, there may be pendant (10) comprising: an anchor portion (12) having three elongated sides (14, 16 and 18), at least two (e.g. 14 and 18) of the three elongated sides having a plurality of v-shaped supports (20), a first end (22) and a second end (24), a bottom substantially rectangular support (26) that is attached on three sides to the second end of each of the three elongated sides (14, 16, 18) to create an open side (28), a bottom side (30) and two parallel elongated sides (14 and 18). Generally, the bottom side (30) is substantially parallel to the open side (28). The two parallel elongated sides (14 and 18) may have a substantially oval shape opening (32 and 34) proximate to the first end (22) and a plurality of v-shaped supports (20). A necklace chain may be threaded through the substantially oval shape opening proximate to the first end to provide a pendant that hangs on a necklace. The elongated sides have openings and supports (the supports may be v-shaped or slanted-I shaped (as shown in FIG. 21). The openings allow light to flow through. The support portions provide stability.

Figure 2:
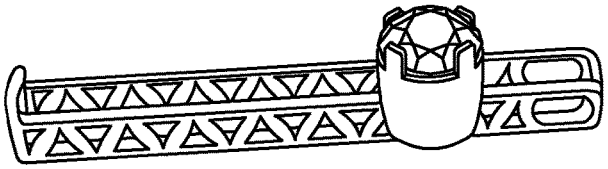
FIG. 2 depicts a gemstone holder being attached to an anchor portion.
Figure 3:
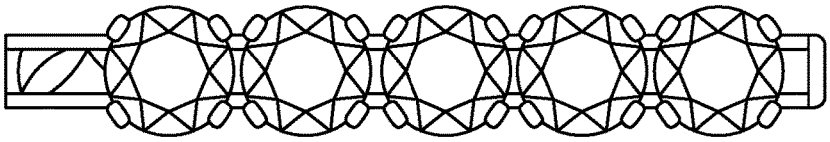
FIG. 3 is intended to depicts the customizable nature of the invention.
Figure 4:
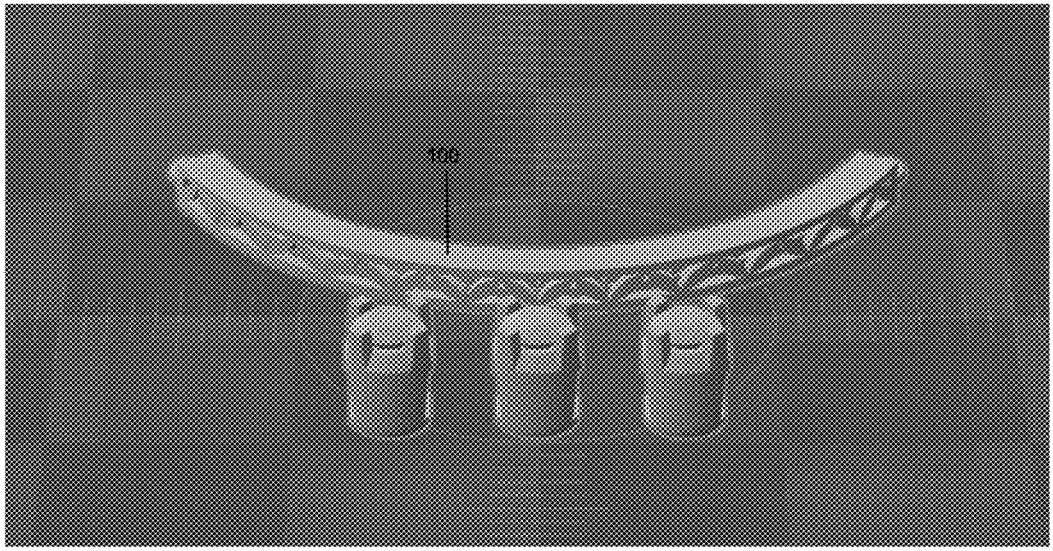
FIG. 4 is a bottom perspective view of a smiley shaped pendant according to the present invention.

The distance between the two parallel elongated sides (14 and 18) increases from the first end (22) to the second end (24) to provide a tapered bar. This is to say the distance between the two parallel elongated sides (14 and 18) at distance (36) would be smaller than the distance between the two parallel elongated sides (14 and 18) at distance (38). This allows for the gemstone holder (40) to be easy installed and secured by gravity. This is an important security function. FIGS. 2 and 3 depict gemstone holders being installed onto the anchor portion. Also, the bottom substantially rectangular support (26) extends above the open side (28)

and the two parallel elongated sides (14 and 18) further preventing the gemstone holder (40) from sliding off. The gemstone holder (40) may have two side portions (42 and 44), a side opening (46) between the two side portions (42 and 44) and a top (46) for the receipt of a gemstone (48) and a bottom opening (50). The bottom opening (50) may have a bar (52) that runs perpendicular to the side opening (46). This allows for light to flow through the gemstone, while still providing stability to the piece and added security that the gemstone will not be lost. One of the goals of the present invention is to allow light to flow through the gemstones, while retaining the gemstone. This is important, as this is what provides the sparkle of a gemstone and enhances its appearance. It is also important that the gemstones be safe and secure. Still further, the present invention allows for different shaped gemstone holders, which may hold different color, size and clarity stones. In this way, the wearer or purchaser can customize the piece. One of the three elongated sides, the bottom side (30) may be solid or may have the v-shaped supports or cross supports (as shown in FIG. 21). The elongated sides (14, 16 and 18) may each have a plurality of v-shaped supports. Alternatively, the bottom side (30) may be solid, without an openings and not having any supports. The gemstone holder (40) may be a variety of shapes, as depicted in FIGS. 10-20, such as a square gemstone holder (1000), a round gemstone holder (1100), an oval gemstone holder (1200), a heart shaped gemstone holder (1300), a quatrefoil shaped gemstone holder (1400), a pentagon shaped gemstone holder (1500), a hexagon shaped gemstone holder (1600), a heptagon shaped gemstone holder, an octagon shaped gemstone holder, a nonagon shaped gemstone holder, a decagon shaped gemstone holder, a triangular shaped gemstone holder (1700), a crescent shaped gemstone holder (1800), an ellipse shaped gemstone holder, a trapezoid shaped gemstone holder (1900), a kite shaped gemstone holder (2000) and a rhombus shaped gemstone holder. The dotted lines in each of the FIGS. 11-20 depict the side opening. The anchor portion and the side opening are square or rectangular in shaped. Because of this, they do not rotate. Further, a heart, for example, will appear with the gemstone side up at all times, unlike a traditional pendant which can turn.

Figure 5:
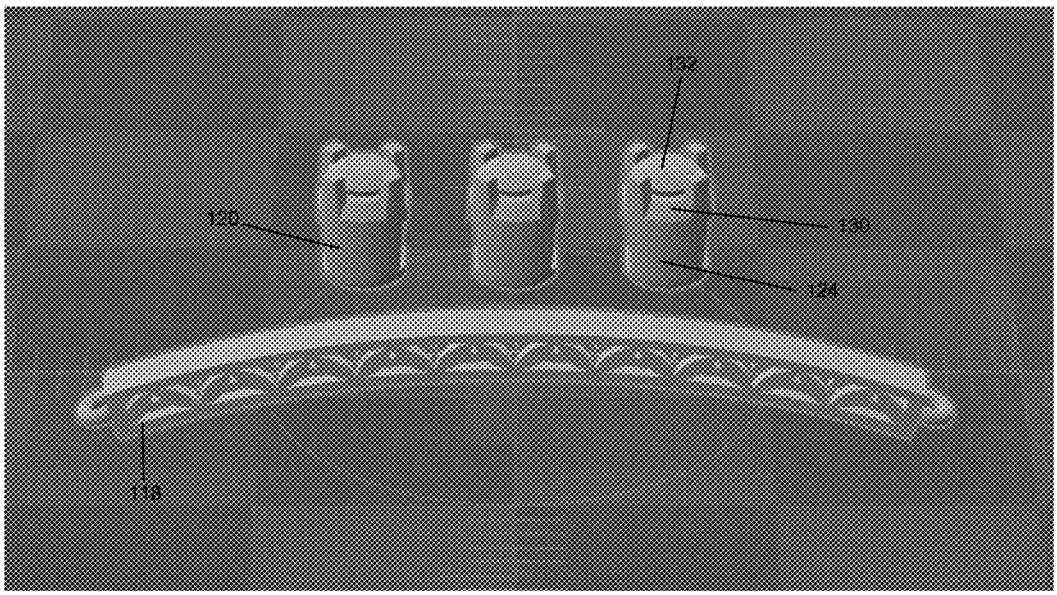
FIG. 5 is a side perspective view of a bracelet pendant shape according to the present invention.
Figure 6:
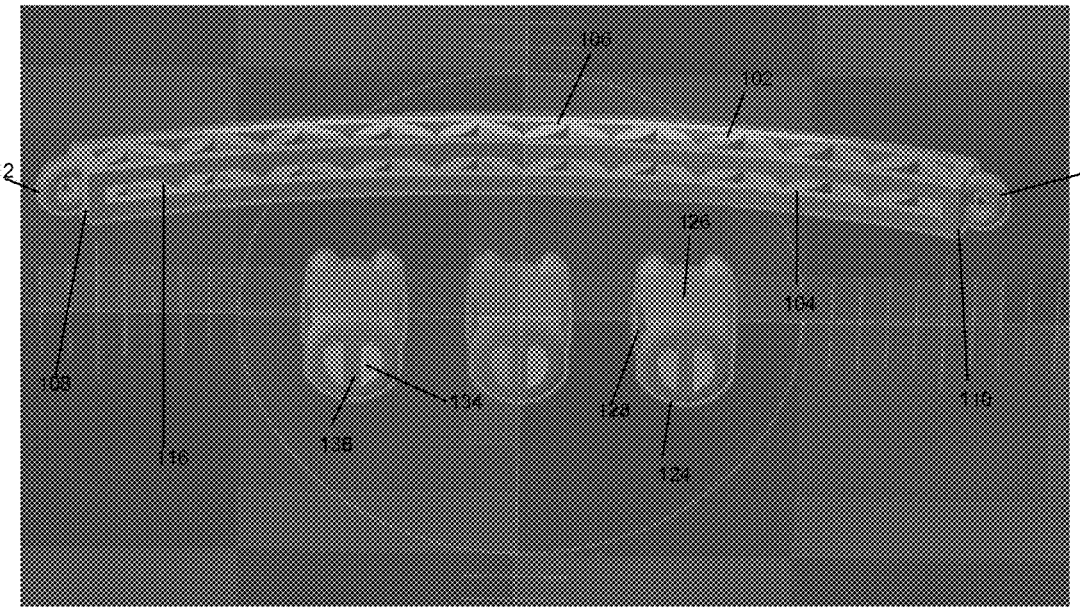
FIG. 6 is a bottom perspective view of a bracelet pendant shape according to the present invention.
Figure 7:
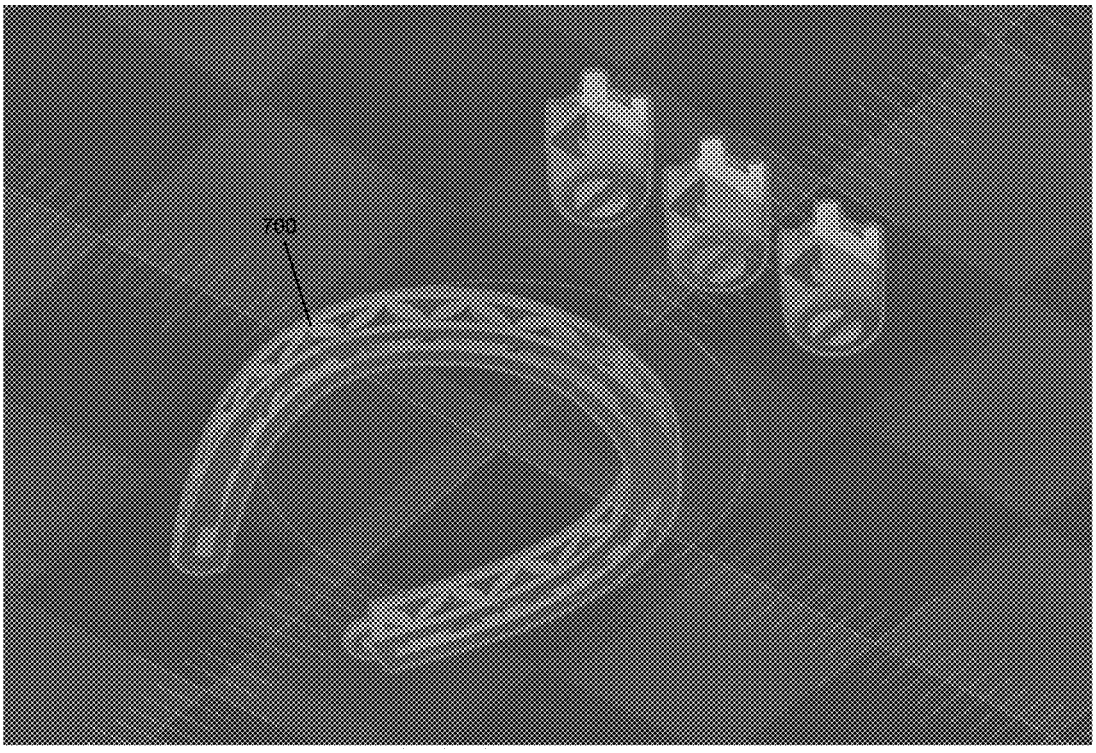
FIGS. 7-8 are a horseshoe shape of a pendant according to the present invention.
Figure 8:
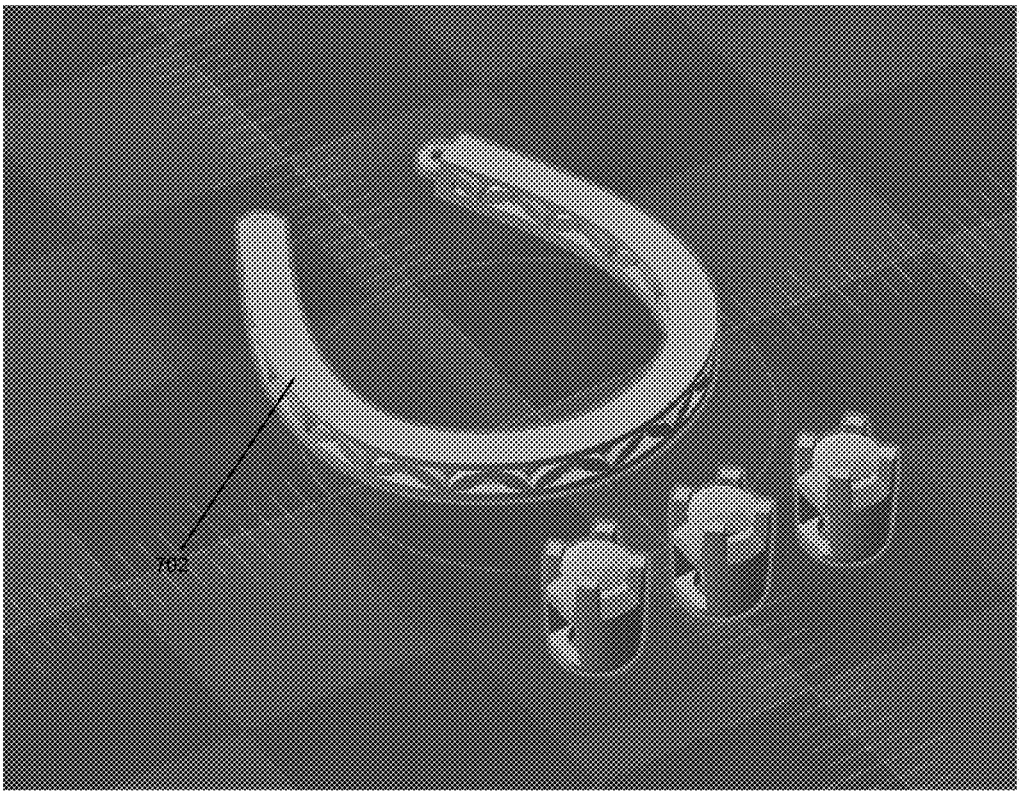
Figure 9:
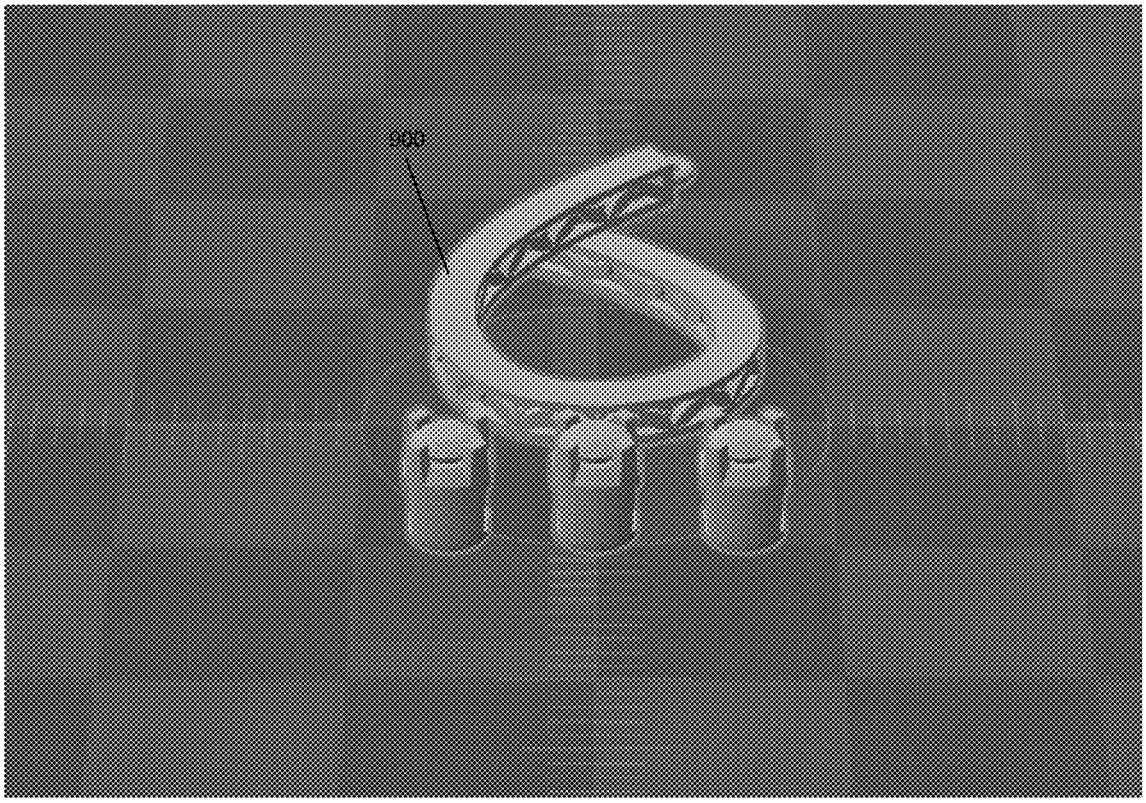
FIG. 9 is an over-under shape of a pendant according to the present invention.
Figure 10:
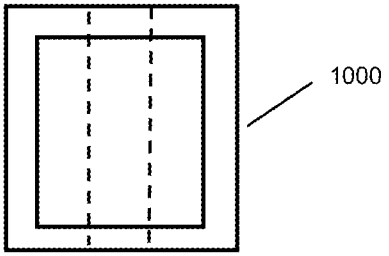
FIG. 10-20 depict different shapes the gemstone holder may be.
Figure 11:
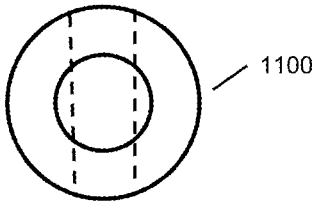
Figure 12:
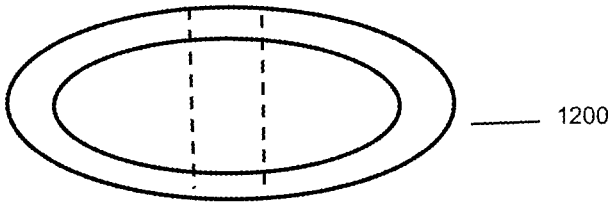
Figure 13:
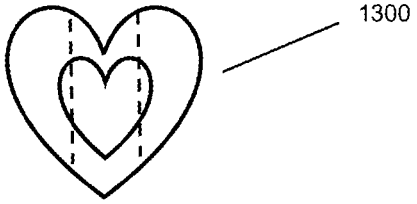
Figure 14:
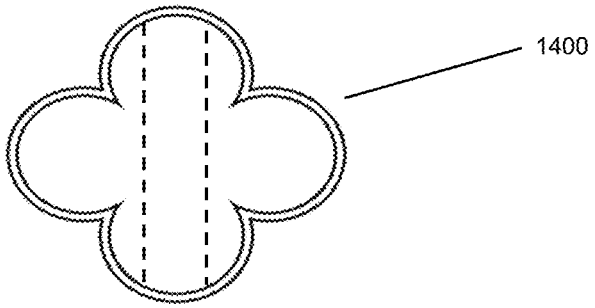
Figure 15:
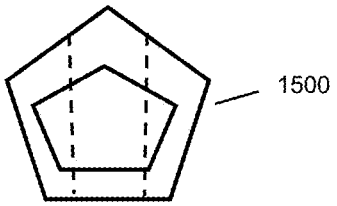
Figure 16:
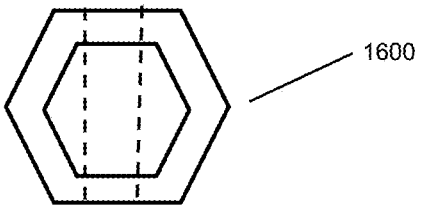
Figure 17:
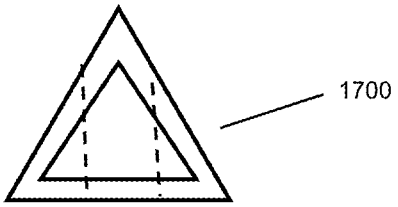
Figure 18:
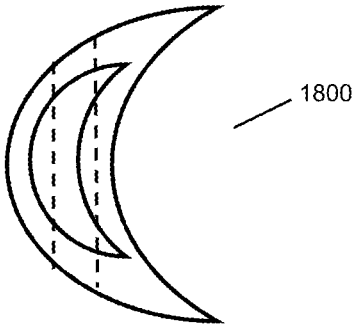
Figure 19:
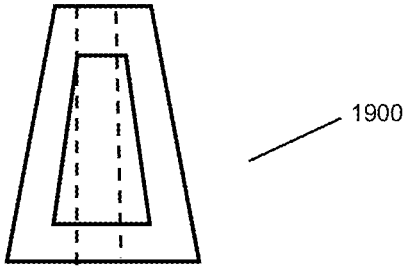
Figure 20:
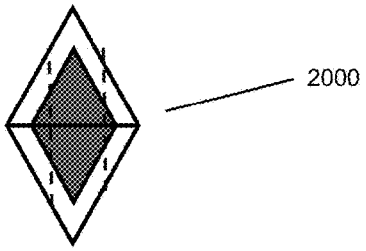
Figure 22:
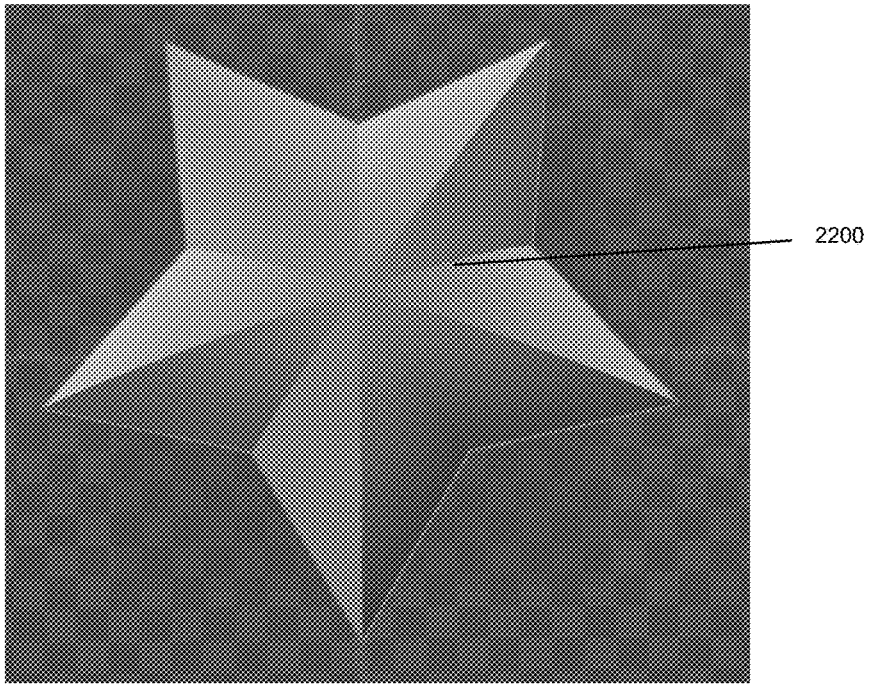
FIGS. 22-23 depict a star shaped gemstone holder.
Figure 23:
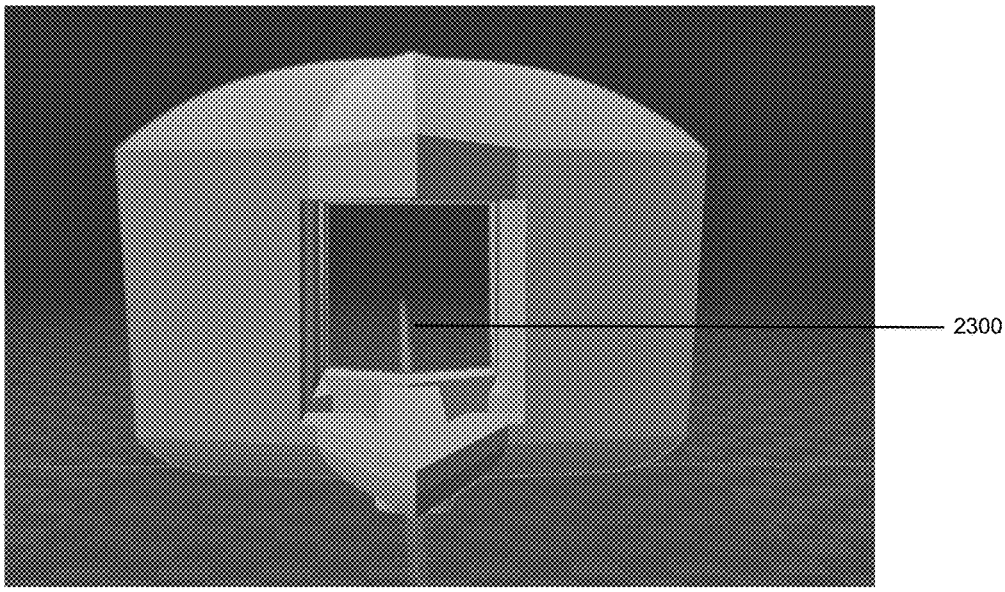

According to another embodiment, as shown in FIGS. 5 and 6, there may be a pendant having an anchor portion having three elongated sides (100, 102 and 104), at least two of the three elongated sides (102 and 104) having a plurality of v-shaped supports (106), a first end support (108) and a second end support (110), at least one rounded opening (e.g. 112 and 114) attached to at least one of the first end support (108) and the second end support (110). The v-shaped support (106) may also be described as triangle shaped cutout portions, depending on whether you are looking at the removed portions or the remaining portions. The at least one rounded opening attached to at least one of the first end support and the second end support, as shown, is a first rounded opening (112) attached to the first end support (108) and a second rounded opening (114) attached to the second end support (110). This may be particularly suitable for a necklace or bracelet chain to be attached. For example, to provide a bracelet, a first half of a bracelet chain may be attached by a jump ring to the first rounded opening and a second half of a bracelet chain may be attached by a jump ring to the second rounded opening. The first half and the second half of the bracelet chain may then have mated clasps on the other end of the chain (away from the jump rings attached to the first rounded opening and the second rounded opening). The three elongated sides (100, 102 and 104) are attached to the first end support (108) and the second end support (110) to create an open side (116), a bottom side (118) and two substantially parallel elongated sides (102 and 104). A gemstone holder having a two side portions (124 and 126), a side opening (128) between the two side portions (124 and 126), a top (130) for the receipt of a gemstone (132) and a bottom opening (134). The side opening (128) runs the entire length of the gemstone holder (102) to allow it to slide onto the anchor portion. The bottom opening (134) of the gemstone holder (102) may have a bar (136) that runs perpendicular to the side opening (128). One of the three elongated sides may solid, typically the bottom side (118). Alternatively, wherein the three elongated sides may each have a plurality of v-shaped supports (106). The anchor portion may be bent into a shape selected from the group consisting of a horseshoe shape (700, 702), a smiley shape (100), an over-under shape (900) and a bracelet bar shape (smiley shape (100) may be the same as a bracelet bar shape, or the smiley shape may be slightly more curved). FIGS. 22 and 23 depict a rendering of a star shaped gemstone holder (2200) with a side opening (2300). As can be seen, regarding of the shape of the gemstone holder, the side opening is generally rectangular in shape and slightly larger than the part of the anchor portion formed by the three elongated sides. It should also be understood that the gemstone holder may be any shape of any charm, without departing from the present invention. For example, a train charm for a new mom of a baby boy, a graduation cap for a recent graduate. Again, in this way the pendant is customizable. Also, the substantially rectangular nature of the side opening in the gemstone holder ensures the gemstone will lay flat with the gemstone on the top.

The pendant may have an anchor portion having three elongated sides, at least two of the three elongated sides having a plurality of cross supports (2100), a first end (2102) and a second end (2104), a bottom substantially rectangular support that (2106) is attached on three sides to the second end of each of the three elongated sides to create an open side, a bottom side and two parallel elongated sides, wherein the two parallel elongated sides may have a substantially oval shape opening (2108) proximate to the first end (2102). The bottom substantially rectangular support (2106) extends above the open side and the two parallel elongated sides. As before, there may be a gemstone holder having a two side portions, a side opening between the two side portions, a top for the receipt of a gemstone and a bottom opening. The bottom opening of the gemstone holder may have a bar that runs perpendicular to the side opening. One of the three elongated sides (typically the bottom side) may be solid.

The present invention has been described in relation to particular examples, which are intended to be illustrative rather than restrictive, with the scope and spirit of the invention being indicated by the following claims and their equivalents.

The invention claimed is:

1. A pendant comprising:

an anchor portion having three elongated sides, at least two of the three elongated sides having a plurality of supports, a first end and a second end, a bottom substantially rectangular support that is attached on three sides to the second end of each of the three elongated sides to create an open side, a bottom side and two parallel elongated sides, wherein the two parallel elongated sides have a substantially oval shape opening proximate to the first end and having the plurality of supports;

wherein the bottom substantially rectangular support extends above the open side and the two parallel elongated sides; and a gemstone holder having two side portions, a side opening between the two side portions, a top for the receipt of a gemstone and a bottom opening.

2. A pendant as in claim 1, wherein the bottom opening of the gemstone holder has a bar that runs perpendicular to the side opening.

3. A pendant as in claim 1, wherein one of the three elongated sides is solid.

4. A pendant as in claim 1, wherein the supports are v-shaped supports.

5. A pendant as in claim 1, wherein each of the three elongated sides have a plurality of v-shaped supports.

6. A pendant in claim 1, wherein the gemstone holder is selected from the group consisting of a square gemstone holder, a cushion gemstone holder, a pear shaped gemstone holder, a round gemstone holder, an oval gemstone holder, a heart shaped gemstone holder, quatrefoil shaped gemstone holder, a pentagon shaped gemstone holder, a hexagon shaped gemstone holder, a heptagon shaped gemstone holder, an octagon shaped gemstone holder, a nonagon shaped gemstone holder, a decagon shaped gemstone holder, a triangular shaped gemstone holder, a crescent shaped gemstone holder, an ellipse shaped gemstone holder, a trapezoid shaped gemstone holder, a kite shaped gemstone holder and a rhombus shaped gemstone holder.

7. A pendant as in claim 1, wherein the distance between the two parallel elongated sides increases from the first end to the second end to provide a tapered bar.

8. A pendant as in claim 1, further comprising a necklace chain that is threaded through the substantially oval shape opening proximate to the first end.

9. A pendant comprising:

an anchor portion having three elongated sides, at least two of the three elongated sides having a plurality of v-shaped supports, a first end support and a second end support, at least one rounded opening attached to at least one of the first end support and the second end support, wherein the three elongated sides are attached to the first end support and the second end support to create an open side, a bottom side and two substantially parallel elongated sides; and a gemstone holder having two side portions, a side opening between the two side portions, a top for the receipt of a gemstone and a bottom opening.

10. A pendant as in claim 9, wherein the bottom opening of the gemstone holder has a bar that runs perpendicular to the side opening.

11. A pendant as in claim 9, wherein one of the three elongated sides is solid.

12. A pendant as in claim 9, wherein the three elongated sides each have a plurality of v-shaped supports.

13. A pendant in claim 9, wherein the gemstone holder is selected from the group consisting of a square gemstone holder, a cushion gemstone holder, a pear shaped gemstone holder, a round gemstone holder, an oval gemstone holder, a heart shaped gemstone holder, quatrefoil shaped gemstone holder, a pentagon shaped gemstone holder, a hexagon shaped gemstone holder, a heptagon shaped gemstone holder, an octagon shaped gemstone holder, a nonagon shaped gemstone holder, a decagon shaped gemstone holder, a triangular shaped gemstone holder, a crescent shaped gemstone holder, an ellipse shaped gemstone holder, a trapezoid shaped gemstone holder, a kite shaped gemstone holder and a rhombus shaped gemstone holder.

14. A pendant as in claim 9, wherein the at least one rounded opening attached to at least one of the first end support and the second end support is a first rounded opening attached to the first end support and a second rounded opening attached to the second end support.

15. A pendant as in claim 9, wherein the anchor portion is bent into a shape selected from the group consisting of a horseshoe shape, a smiley shape, an over-under shape and a bracelet bar shape.

16. A pendant as in claim 9, further comprising a chain that is attached to the at least one rounded opening.

17. A pendant comprising:

an anchor portion having three elongated sides, at least two of the three elongated sides having a plurality of cross supports, a first end and a second end, a bottom substantially rectangular support that is attached on three sides to the second end of each of the three elongated sides to create an open side, a bottom side and two parallel elongated sides, wherein the two parallel elongated sides have a substantially oval shape opening proximate to the first end;

wherein the bottom substantially rectangular support extends above the open side and the two parallel elongated sides; and a gemstone holder having two side portions, a side opening between the two side portions, a top for the receipt of a gemstone and a bottom opening.

18. A pendant as in claim 17, wherein the bottom opening of the gemstone holder has a bar that runs perpendicular to the side opening.

19. A pendant as in claim 17, wherein one of the three elongated sides is solid.

20. A pendant in claim 17, wherein the gemstone holder is selected from the group consisting of a square gemstone holder, a cushion gemstone holder, a pear shaped gemstone holder, a round gemstone holder, an oval gemstone holder, a heart shaped gemstone holder, quatrefoil shaped gemstone holder, a pentagon shaped gemstone holder, a hexagon shaped gemstone holder, a heptagon shaped gemstone holder, an octagon shaped gemstone holder, a nonagon shaped gemstone holder, a decagon shaped gemstone holder, a triangular shaped gemstone holder, a crescent shaped gemstone holder, an ellipse shaped gemstone holder, a trapezoid shaped gemstone holder, a kite shaped gemstone holder and a rhombus shaped gemstone holder.

* * * * *